United States Patent [19]

Grohn et al.

[11] Patent Number: 5,007,401

[45] Date of Patent: Apr. 16, 1991

[54] MAGNETIC VALVE CONTROLLED INJECTION DEVICE

[75] Inventors: Michael Grohn, Waiblingen-Hegnach; Mario Mürwald, Kernen; Frank Thoma; Karlheinz Hoffmann, both of Stuttgart, all of Fed. Rep. of Germany

[73] Assignee: Daimler-Benz AG, Fed. Rep. of Germany

[21] Appl. No.: 102,711

[22] Filed: Sep. 30, 1987

[30] Foreign Application Priority Data

Sep. 30, 1986 [DE] Fed. Rep. of Germany ..... 3633136

[51] Int. Cl.[5] ..... F02M 37/04

[52] U.S. Cl. ..... 123/509; 123/470

[58] Field of Search ..... 123/509, 446, 458, 495, 123/506, 508, 470, 471, 472; 239/600; 417/499, DIG. 1

[56] References Cited

U.S. PATENT DOCUMENTS

| | | | |
|---|---|---|---|
| 2,354,403 | 7/1944 | Reggio | 123/509 |
| 4,522,182 | 6/1985 | Mowbray | 123/509 |
| 4,567,872 | 2/1986 | Roosa | 123/470 |
| 4,599,983 | 7/1986 | Omachi | 123/509 |
| 4,615,323 | 10/1986 | Leblanc | 123/509 |

FOREIGN PATENT DOCUMENTS

| | | |
|---|---|---|
| 694245 | 6/1940 | Fed. Rep. of Germany . |
| 825628 | 3/1938 | France . |
| 2131873 | 6/1984 | United Kingdom . |

OTHER PUBLICATIONS

"Das Integrierte Kraftstoffeinspritzsystem Für Direkteinspritz-Dieselmotoren", Günter Elsbeth, pp. 2.50 through 2.53, No Date Given, C.S.M.

*Primary Examiner*—Carl Stuart Miller

*Attorney, Agent, or Firm*—Evenson, Wands, Edwards, Lenahan & McKeown

[57] ABSTRACT

The invention concerns a magnetic valve controlled fuel injection device for internal combustion engines, in which a fuel pump is driven by a drive element from the cylinder head camshaft and is located separately from a fuel nozzle and connected thereto by a relatively short exposed injection pipe; and wherein the fuel pump or nozzle forms a structural unit jointly with the magnetic valve, which controls the beginning and end of pumping as a function of operating parameters of the internal combustion engine; and wherein this unit is secured to the cylinder head in such a way that at least one casing part of the aid pump, facing away from the drive element, and the magnetic valve are located outside the space enclosed by the cylinder head and the cylinder head cover.

18 Claims, 3 Drawing Sheets

MAGNETIC VALVE CONTROLLED INJECTION DEVICE

BACKGROUND AND SUMMARY OF THE INVENTION

The invention concerns a magnetic valve controlled injection device consisting of pump and nozzle for air compression internal combustion engines having a mounting hole means for a fuel pump casing in the cylinder head of the engine wherein there is a pump piston, displaced longitudinally in the pump casing and driven by a camshaft, supported from the cylinder head, via a drive element, and which pump piston shuts off an inlet in the pump working space and wherein a pressure conduit starting from the pump working space—leads to the fuel nozzle and to a magnetic valve controlling the beginning of the pumping and the end of pumping as a function of operating parameters of the internal combustion engine.

A magnetic-valve-controlled injection device of this type is known from GB 21 31 873 A. The pump and nozzle, combined to form a structural unit in this case—generally referred to as pump-nozzle—and the magnetic valve is not easily serviceable because it is necessary to remove the complete structural unit during a nozzle change or pump change. In addition, removal is even more difficult because of the positioning of the cam drive. The pump is fixed over the nozzle. There are high mechanical and hydraulic loads.

An object of the invention is to remove the disadvantages present in this magnetic valve controlled injection device consisting of pump and nozzle and, in addition, to make possible a compact, simple and service friendly structure by means of a special arrangement of pump, nozzle and magnetic valve, this structure ensuring continuous and troublefree operation.

The object is obtained by having a magnetic valve form a structural unit jointly with the fuel pump or fuel nozzle and with a mounting hole being provided in the cylinder head for the fuel pump so that the pump is located separately from the nozzle and is connected to the nozzle by a relatively short exposed pressure pipe and furthermore, that the pump is so mounted that there is no hindrance on the camshaft side for removal of the pump and further that the fuel nozzle is independently fastened to the cylinder head so that it can be removed towards the outside. Additionally, a casing part of the pump, which faces away from a drive element of the pump, and the magnetic valve, which controls the beginning and ending of pumping as a function of operating parameters of the engine, are both located outside the space enclosed by the cylinder head and a cylinder head cover.

These measures according to the invention provide easy accessibility to the injection system. The structural separation of pump and nozzle permits a flat structure and make possible, in a simple and rapid manner, installation and removal of only the structural unit consisting of the nozzle and the magnetic valve, or the pump and the magnetic valve. In addition, installation and removal of the magnetic valve separate from the nozzle or the pump is possible. Because of the special position of the magnetic valve, namely outside the engine oil space, this magnetic valve is subject to substantially smaller thermal loads. Complicated sealing arrangements for the electrical connections are unnecessary.

An injection device with mechanical control consisting of pump and nozzle (Guenter Elsbett, "Das integrierte Kraftstoffeinspritzsystem fuer Direkteinspritz-Dieselmotoren", XIX International Fisita Congress, 8.-12. Nov. 1982, Paper 82029) is known in which the pump does, in fact, have a separate position from the nozzle, but in which there is a complicated mechanical control for both the beginning of pumping and for the quantity of fluid delivered. Because of this, control rods have to bridge the complete length of the cylinder head. The transmission of the stroke motion of the pump piston takes place by means of an intermediate piece which is supported rotatably in a threaded insert in order to permit a change of length of the pump tappet for the purpose of controlling the beginning of pumping. The adjustment principle is complicated and the pump drive can only be dismantled after the removal of the camshaft.

An advantage is obtained by having the fuel pump located at one side of and within a height determined by the length of the fuel nozzle.

Another advantage is obtained by having the fuel pump driven by a longitudinally displaceable roller tappet or alternatively a roller rocker arm.

It is also advantageous to have the fuel pump and magnetic valve as a single unit with a single mounting hole in the cylinder head.

Also a cover can be provided which will act as a wall boundary for a low pressure space in the fuel pump assembly. This space can be connected intermediate the two ends of the fuel pressure pipe leading from the fuel supply to the fuel return. Also advantageous is having a low pressure chamber connector to the conduit leading to the magnetic control valve and thus controlled thereby.

Also advantageous is the fact that the inlet and outlet to the magnetic valve can be reversed in some institutions.

Because the high pressure side of the fuel pipework system is located outside the cylinder head, it is no longer possible for the engine oil to be diluted by fuel entering it. The pressure space on the low pressure side, in its function as pressure wave damper, is also not located in the cylinder head, but rather in the pump casing located outside the cylinder head, so that lower fuel temperature are obtained. Because of the arrangement of the low pressure chamber immediately at the magnetic valve, pressure fluctuations occurring when the magnetic valve is opened are avoided.

These and other objects, features, and advantaged of the present invention will become more apparent from the following description when taken in connection with the accompanying drawings which shows, for the purposes of illustration only, plural embodiments in accordance with the present invention, and wherein:

DETAILED DESCRIPTION OF THE DRAWINGS

Figure 1:
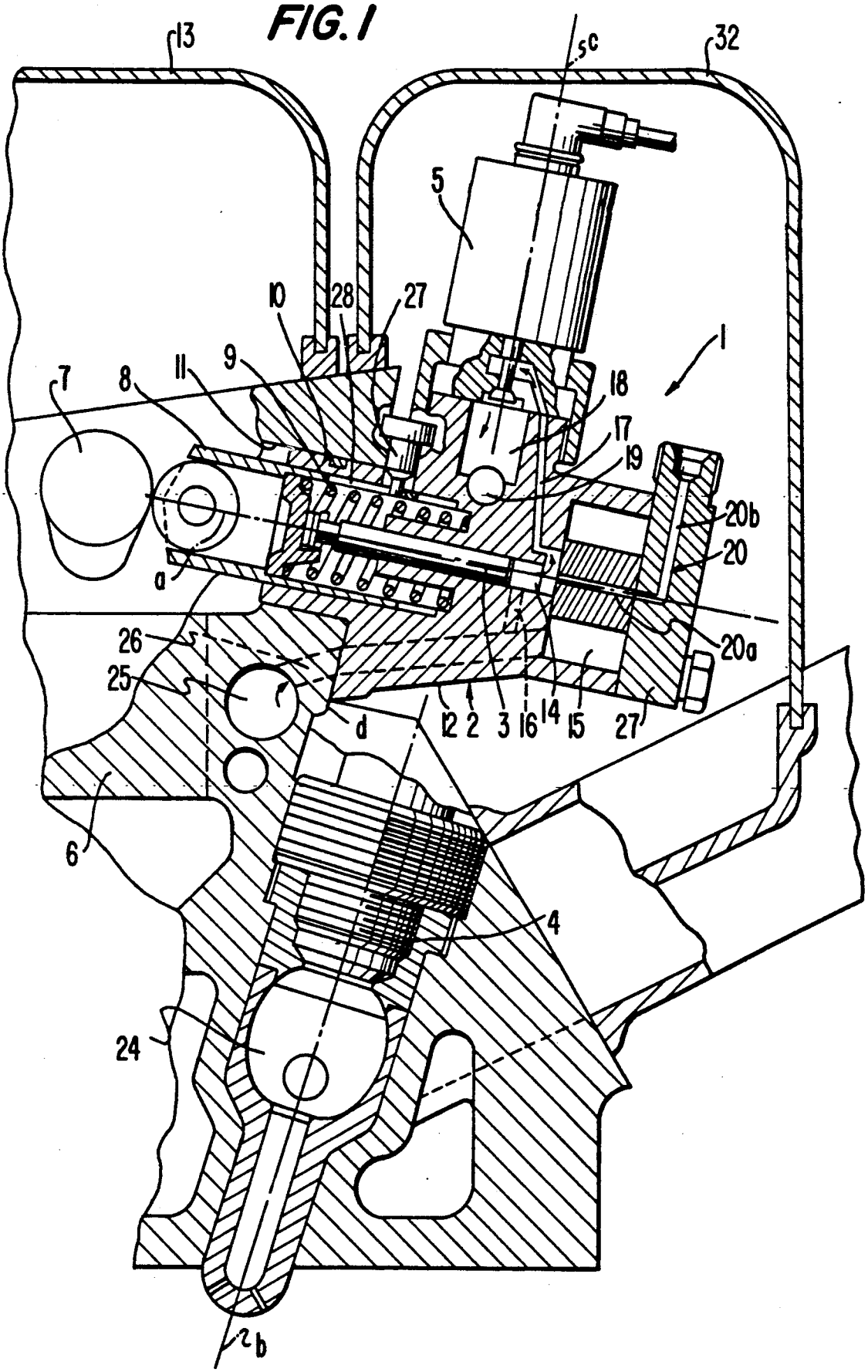
FIG. 1 shows, partially in section, an injection device consisting of pump and nozzle with a roller tappet as drive element for the pump piston.

Referring now to the drawings wherein like reference numerals are used to designate like parts and more particularly to FIG. 1, an injection device 1 for an internal combustion engine with precombustion chamber consists essentially of a pump 2 having a pump piston 3 without metering control, a nozzle 4 separated from the pump at one side thereof and a magnetic valve 5 operating as a function of the operating parameters of the internal combustion engine.

Figure 2:
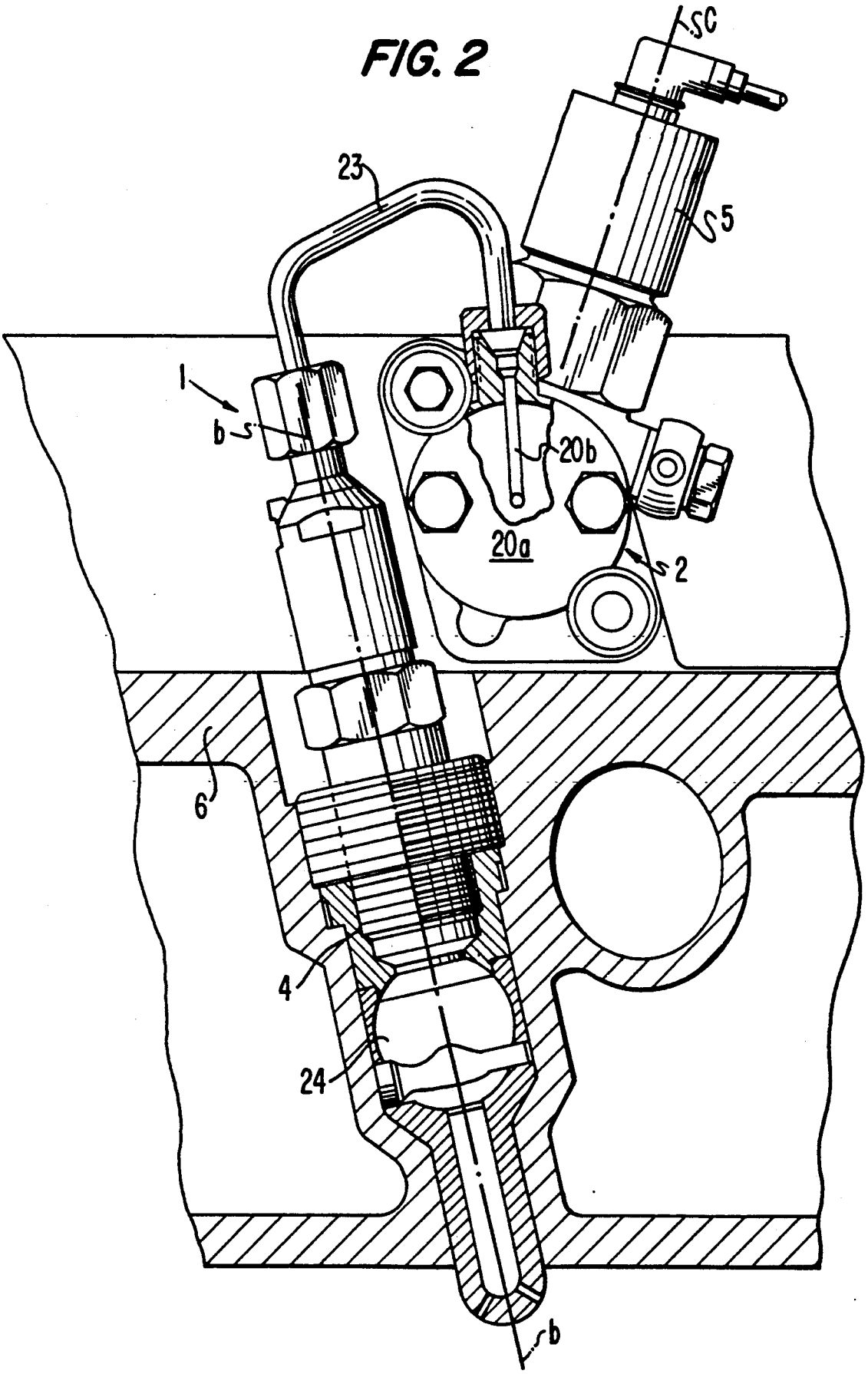
FIG. 2 shows the injection device in side view.

The pump 2 is arranged relative to the nozzle 4 (FIG. 1) in such a way that the pump axis "a" runs approximately at right angles to and offset from the nozzle axis "b", while the axis "c" of the magnetic valve 5 runs approximately at right angles to and in line with the pump axis "a" (FIG. 2).

The pump 2 is combined with the magnetic valve 5 located above it and forms one structural unit which is designed as a plug-in unit. The magnetic valve 5 can however, for structural reasons, form a structural unit with the nozzle 4. The drive of the pump 2 is provided by a camshaft 7 supported in the cylinder head 6 of the internal combustion engine and controlling the gas exchange valves (not shown), which camshaft 7 directly drives the pump piston 3 via a roller tappet 8 in opposition to tappet spring 9.

The pump 2 at the front of casing part 12, facing towards the camshaft 7, is formed by an insertion sleeve 10 which is fitted so as to seal an acceptance hole 11 in the cylinder head 6. The actual fastening and fixing takes place by flanging the structural unit to the cylinder head 6 at the side (fastening plane d). The casing part 12, located to the right of the insertion sleeve 10, is therefore located, in accordance with FIG. 1, near the space enclosed by the cylinder head 6 and the cylinder head cover 13.

The roller tappet 8 is guided so that it can be moved longitudinally in the insertion sleeve 10 and is directly connected with the spring end of the pump piston 3, which is located in the outer dead center position in FIG. 1. The opposite end of the pump piston bounds a pump working space 14, into which emerges a control hole 16 connected to a pressure space on the fuel supply side. The low pressure space 15 acts as a pressure wave damper.

From the pump working space 14, there is a pressure conduit 17 to the magnetic valve 5, which controls the connection to a low pressure chamber 18 which is connected to a fuel tank, not shown, via a return 19. In addition, a pressure conduit 20 leads from the pump working space 14 to the nozzle 4. The pressure conduit 20 is sub-divided into conduit sections **20*a* and 20*b* of which the duct-type conduit section 20*a* extends centrally in the rear part pump casing part 12. Conduit section 20*a* is connected the duct-type conduit 20*b* accommodated in the cover 22 and which conduit 20*b* has a bend. Connected to the conduit section 20*b* is an exposed injection pipe 23 (FIG. 2) of relatively short length which connects the pump 2 to the nozzle 4. The nozzle 4 is screwed into the cylinder head 6 and protrudes into a precombustion chamber indicated by 24**.

The low pressure space 15, designed as an annular space, is located concentrically about the conduit section **20*a*, and is connected with the feed side low pressure supply 25 via a supply duct 26, which branches off the control hole 16**.

In order to secure the roller tappet 8 against rotation, an anti-rotational lock consisting of a pin 27 tappet slot 28 is located in the pump casing.

If required, the exposed magnetic valve 5 and parts of the nozzle 4 and pump 2 located outside the cylinder head 6 can be encapsulated by an easily removable covering hood 32 in order to reduce noise (shown in FIG. 1 only).

Figure 3:
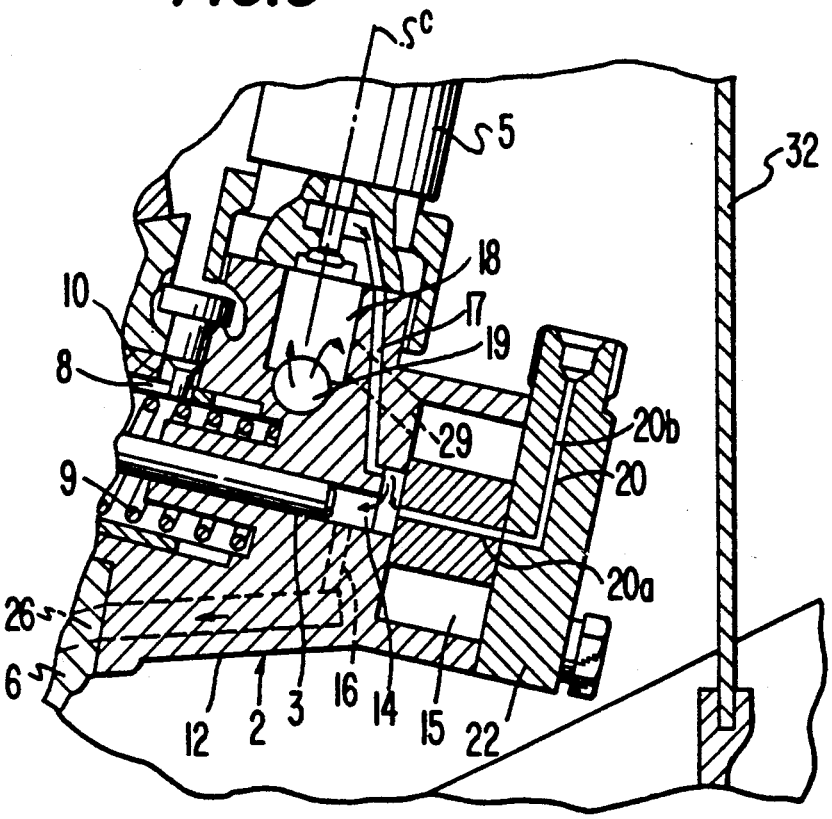
FIG. 3 shows the injection device with a modified drive element utilizing a roller rocker arm.

In FIG. 3, the fuel supply occurs in the reverse flow direction when, for space reasons, it is necessary to change the location of the supply pump (not shown). The return 19 of FIG. 1 now, therefore, becomes the feed and the feed side low pressure supply 25 becomes the return. The cover side pressure space 15 is only connected to the low pressure chamber 18 via a connecting conduit 29. Otherwise, the conduit arrangement remains unaltered.

Figure 4:
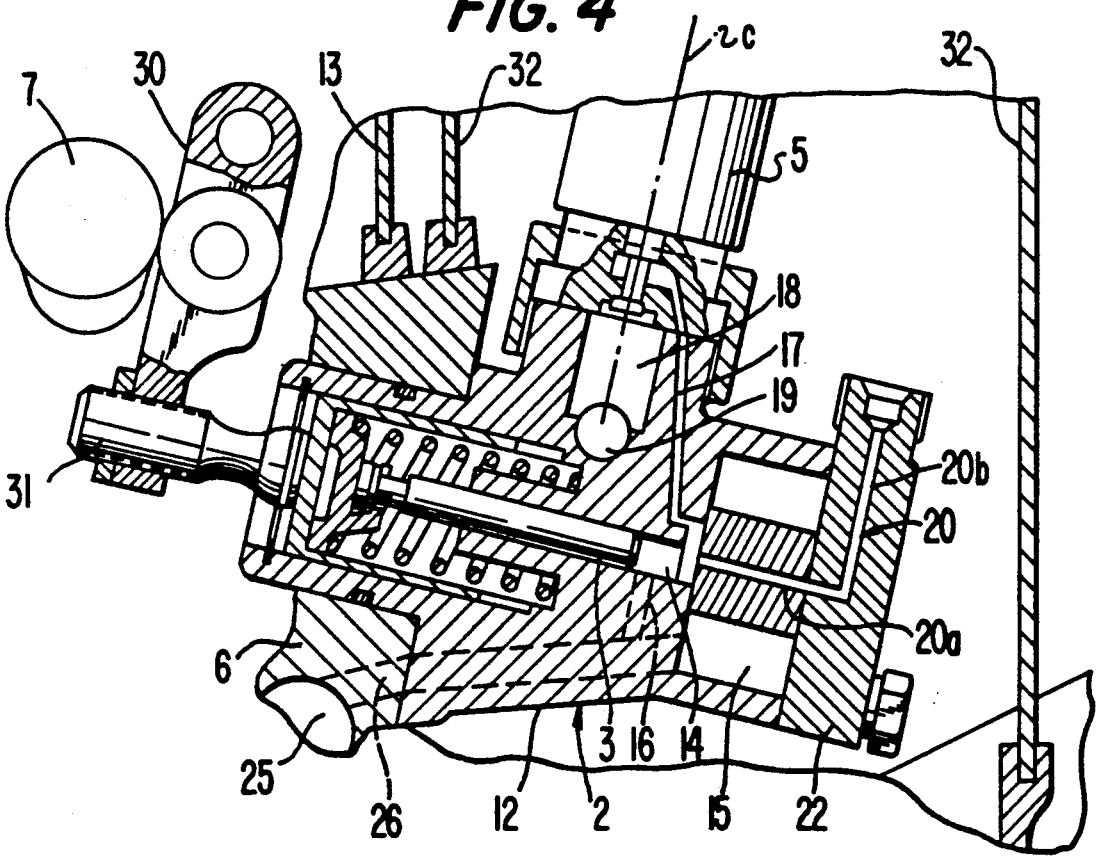
FIG. 4 shows the injection device with a different pipework arrangement (reversing pump inlet and outlet as compared with FIG. 1).

In FIG. 4, a roller tappet 8 is not used as the drive element; instead, the roller rocker arm 30 and tappet 31 directly interacting with the camshaft 7 are used as the drive element. The tappet 31 is solidly connected in its direction of action with the roller rocker arm 30. In this arrangement, the anti-rotational lock 27, 28 disappears.

The mode of operation of the injection device is as follows:

Fuel is continuously pumped by a supply pump and arrives, when the control hole 16 is opened, in the pump working space. The fuel is then transferred from the pump working space via either the pressure line 20 and the injection pipe 23 to the nozzle 4 or via the pressure conduit 17 and the open magnetic valve 5 into the low pressure chamber 18 and finally into the return 19. As soon as the pump piston 3 closes the control hole 16 and the electronically controlled magnetic valve 5 then shuts off the fuel flow, the beginning of pumping commences. Fuel is injected into the precombustion chamber 24. The end of pumping is fixed by the opening of the magnetic valve 5.

While we have shown and described plural embodiments in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

What is claimed:

1. A magnetic valve controlled fuel injection device comprising:

a fuel pump in a pump casing; and a fuel nozzle for internal combustion engines; a mounting means hole for the fuel pump casing in a cylinder head of the engine; a guide fuel pump piston means in the casing displaceable longitudinally thereof by a camshaft means via a drive element, supported from the cylinder head side; said pump piston means shutting off a control hole emerging in a pump working space; a second mounting hole means provided in the cylinder head for the fuel nozzle; pressure conduit means starting from the pump working space and leading to the fuel nozzle and to a magnetic valve means controlling the beginning of pumping and the end of pumping as a function of operating parameters of the internal combustion engine; the magnetic valve means forming a structural unit jointly with at least one of the fuel pump and the fuel nozzle; the first mounting hole means for the pump being provided in the cylinder head; the pump being located separately from the fuel nozzle and connected to the fuel nozzle by a relatively short exposed pressure pipe means; the first mounting hole means for the pump allowing for unencumbered removal of the pump from the camshaft means; the fuel nozzle being independently fastened to the cylinder head by said second hole mounting means to be removable towards the outside of the engine; and a portion of the casing, facing away from the drive element and the magnetic valve means being both located outside the space enclosed by the cylinder head and a cylinder head cover.

2. An injection device according to claim 1, wherein the pump is located to one side of and within a height determined by the length of the fuel nozzle.

3. An injection device according to claim 1, wherein the drive element means is directly driven by the camshaft and comprises a longitudinally displaceable roller tappet.

4. An injection device according to claim 2, wherein the drive element means is directly driven by the camshaft and comprises a longitudinally displaceable roller tappet.

5. An injection device according to claim 1, wherein the drive element means comprises a roller rocker arm and a longitudinally displaceable tappet acting on the pump piston means.

6. An injection device according to claim 2, wherein the drive element means comprises a roller rocker arm and a longitudinally displaceable tappet acting on the pump piston means.

7. An injection device according to claim 1, wherein the pump and magnetic valve means are a singular plug-in unit for insertion in the first mounting hole means in the cylinder head.

8. An injection device according to claim 2, wherein the pump and magnetic valve means are a singular plug-in unit for insertion in the first mounting hole means in the cylinder head.

9. An injection device according to claim 3, wherein the pump and magnetic valve means are a singular plug-in unit for insertion in the first mounting hole means in the cylinder head.

10. An injection device according to claim 4, wherein the pump and magnetic valve means are a singular plug-in unit for insertion in the first mounting hole means in the cylinder head.

11. An injection device according to claim 5, wherein the pump and magnetic valve means are a singular plug-in unit for insertion in the first mounting hole means in the cylinder head.

12. An injection device according to claim 6, wherein the pump and magnetic valve means are a singular plug-in unit for insertion in the first mounting hole means in the cylinder head.

13. An injection device according to claim 1, wherein the casing part, facing away from the drive element means of the pump is closed by a cover acting as a wall boundary for a low pressure side pressure space.

14. An injection device according to claim 2, wherein the casing part, facing away from the drive element means of the pump is closed by a cover acting as a wall boundary for a low pressure side pressure space.

15. An injection device according to claim 1, wherein the pressure pipe means has two ends, one connecting with a fuel supply and the other with a fuel return and with an intermediate connection to a fuel pressure space.

16. An injection device according to claim 2, wherein the pressure pipe means has two ends, one connecting with a fuel supply and the other with a fuel return and with an intermediate connection to a fuel pressure space.

17. An injection device according to claim 1, wherein a low pressure chamber is connected to a portion of the pressure conduit means leading to the magnetic valve means and is controlled by the magnetic valve means.

18. An injection device according to claim 2, wherein a low pressure chamber is connected to a portion of the pressure conduit means leading to the magnetic valve means and is controlled by the magnetic valve means.

* * * * *